US007195067B2

(12) United States Patent
Manke et al.

(10) Patent No.: US 7,195,067 B2
(45) Date of Patent: Mar. 27, 2007

(54) METHOD AND APPARATUS FOR WELL PERFORATING

(75) Inventors: Kevin R. Manke, Marlow, OK (US); Matthew T. Howell, Duncan, OK (US); Don S. Folds, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 187 days.

(21) Appl. No.: 10/910,058

(22) Filed: Aug. 3, 2004

(65) Prior Publication Data

US 2006/0027368 A1 Feb. 9, 2006

(51) Int. Cl.
*E21B 43/11* (2006.01)

(52) U.S. Cl. ..... 166/298; 166/55

(58) Field of Classification Search ..... 166/55, 166/55.2; 175/424
See application file for complete search history.

(56) References Cited

U.S. PATENT DOCUMENTS 3,741,305 A * 6/1973 Young et al. ..... 166/336
3,986,554 A * 10/1976 Nutter ..... 166/319
4,346,761 A * 8/1982 Skinner et al. ..... 166/206
5,156,207 A * 10/1992 Haugen et al. ..... 166/142
5,180,007 A 1/1993 Manke et al.
5,325,923 A 7/1994 Surjaatmadja et al.
5,361,856 A 11/1994 Surjaatmadja et al.
5,494,103 A 2/1996 Surjaatmadja et al.
5,499,678 A 3/1996 Surjaatmadja et al.
5,533,571 A 7/1996 Surjaatmadja et al.
5,765,642 A 6/1998 Surjaatmadja
6,286,599 B1 9/2001 Surjaatmadja et al.

* cited by examiner

*Primary Examiner*—Frank Tsay
(74) *Attorney, Agent, or Firm*—John W. Wustenberg; McAfee & Taft

(57) ABSTRACT

Apparatus for cutting openings in a wall of a well. The apparatus includes a mandrel with a jetting sleeve slidably disposed about the mandrel. The mandrel has a plurality of slots defined therein and the jetting sleeve has a plurality of jetting openings aligned with the slots so that fluid will pass through the mandrel, the slots in the mandrel, and the jetting openings. The jetting nozzles are received in the jetting openings and travel in the slots in the mandrel. The flow of jetting fluid through the mandrel causes the jetting sleeve to move on the mandrel so that slots may be cut in the wall of the well.

36 Claims, 4 Drawing Sheets

METHOD AND APPARATUS FOR WELL PERFORATING

This invention relates to apparatus and methods for cutting openings in wells, and more particularly to a perforating apparatus which can cut slots in a well casing.

There are a number of methods used in perforating wells which are well known. One of those methods includes utilizing a jetting tool through which a jetting fluid passes at a pressure high enough to cut openings, or perforate the well casing. The jetting tool, typically including a plurality of jetting nozzles, is lowered into the well on the tubing string through which jetting fluid is displaced.

It is often desirable to cut slots in the wells as opposed to simply creating holes, or generally circular areas. Slots create a greater area through which treating fluid can be passed and also a greater area for the return of production fluid from the formation. One technique that has been attempted to cut slots in casing requires mounting jet nozzles in a spring-loaded tool. Such an arrangement is shown in FIGS. 7 and 8. The prior art tool 2 shown in FIG. 7 has a jetting sub 4 with a spring 6 positioned therebelow. FIG. 7 shows tool 2 with spring 6 compressed as a result of the tool 2 being set, and weight applied from the surface by a tubing string used to lower tool 2 into a well. The tubing string is lifted, and the upward pull, along with the spring force applied by spring 6, causes jetting sub 4 to move upwardly as shown in FIG. 8. Fluid is jetted through jetting sub 4 to cut openings in the wellbore wall, which in many cases is defined by a casing in the well. Although the arrangement works well to create slots in a casing, greater control of upward travel is desired while at the same time maintaining weight to set down on the packer.

SUMMARY

The current invention is directed to an apparatus for cutting openings in the wall of a well. The apparatus is more particularly directed to perforating or cutting slots in a casing. The apparatus includes a mandrel defining a flow passage therethrough. The mandrel is lowered into the well on a tubing, which may be for example but is not limited to a coiled tubing. The mandrel has a plurality of slots defined therein and is plugged at a lower end thereof so that the fluid flowing through the mandrel is forced through the slots.

A sleeve, which may be referred to as a jetting sleeve, is slidably disposed about the mandrel. The jetting sleeve is movable on the mandrel between first and second positions. The jetting sleeve has a plurality of jetting openings therein. Jetting fluid is displaced downwardly through the tubing into the mandrel. The jetting fluid passes through the slots in the mandrel and the jetting openings in the jetting sleeve, and will cut openings in the wall of the well, such as slots in the casing in the well. The jetting openings preferably have jetting nozzles therein which extend into and travel in the slots defined in the mandrel.

The jetting fluid is displaced through the mandrel at a rate sufficient to cause the jetting sleeve to move axially on the mandrel from the first position toward the second position thereof, which preferably is in the direction of the jetting fluid through the mandrel. The jetting fluid will exit the mandrel through the slots and will pass through the jetting openings. As the jetting sleeve moves on the mandrel, it will cut slots in the wall of the well which will match the shape of the slot in the mandrel. The apparatus includes a means for applying force to a second end of the jetting sleeve, such as a spring, to push the jetting sleeve towards the first position thereof on the mandrel. The rate of the jetting fluid can be slowed so that the spring will move the jetting sleeve toward the first position thereof. Reciprocation of the sleeve on the mandrel causes the slots of the desired shape to be cut in the well.

The apparatus may include a metering device disposed in an annular chamber for controlling the rate of the longitudinal movement of the sleeve. The metering device may comprise an annular ring with first and second longitudinal passageways defined therein. A fluid restrictor is disposed in one of the first or second passageways for controlling the rate of movement of the sleeve while the other longitudinal passageway may have a check valve disposed therein. The metering device is positioned in the annular chamber defined by the jetting sleeve and the mandrel.

DETAILED DESCRIPTION

Figure 1:
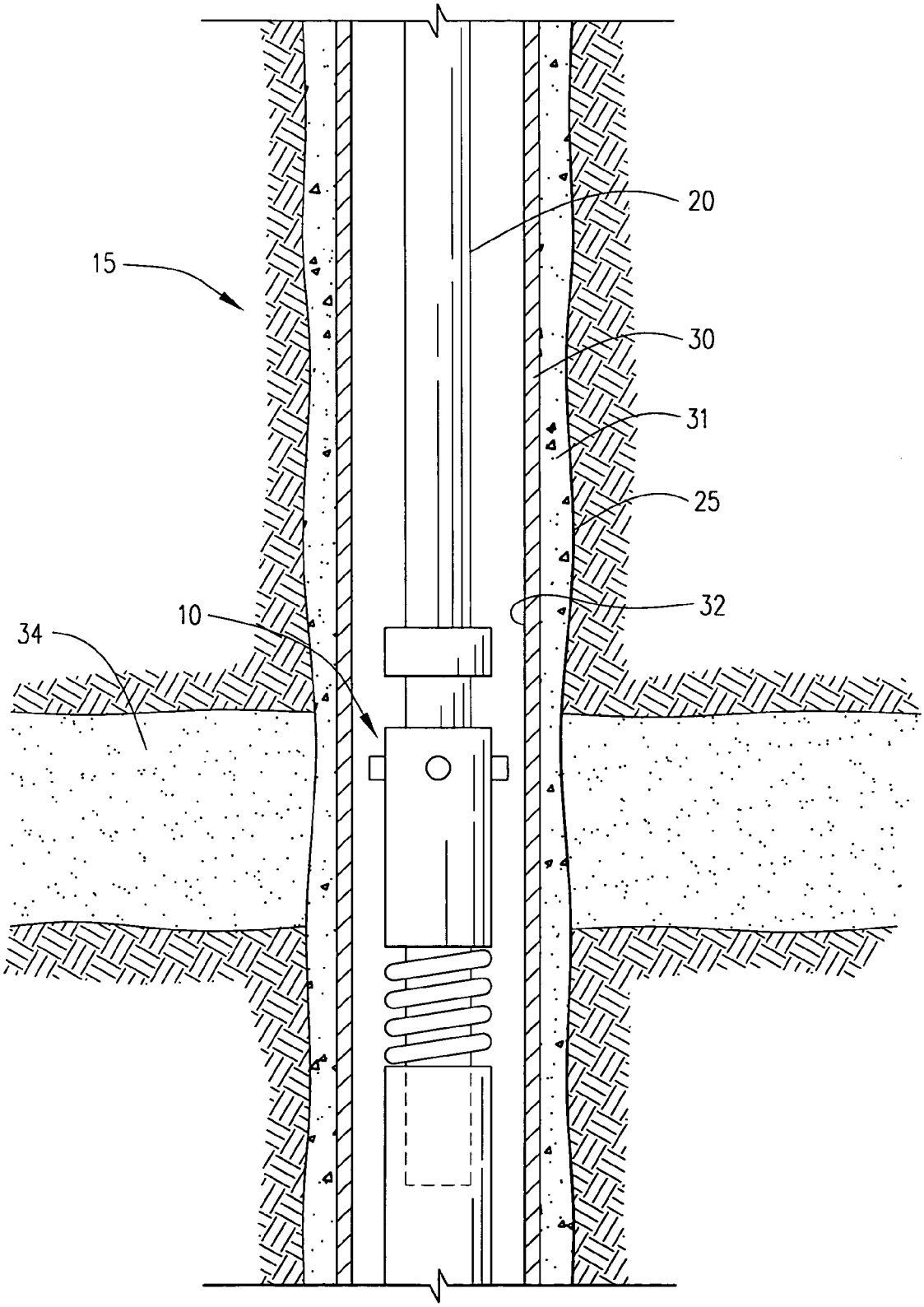
FIG. 1 schematically shows the perforating tool of the present invention lowered into a well on a tubing.

Referring now to the figures and more particularly to FIG. 1, the jetting tool or apparatus 10 is schematically shown lowered in a well 15 on a tubing 20. The tubing 20 may be coiled tubing or may be jointed tubing as is known in the art. Well 15 comprises a wellbore 25 having a casing 30 cemented therein with cement 31. Although the jetting tool 10 is shown lowered into a well having casing, it is understood that the jetting tool 10 may likewise be utilized in wellbores in which no casing is utilized. Casing 30 defines a wall 32 of well 15. Jetting tool 10 may be connected to tubing 20 by connectors or collars as is known in the art.

Figure 2:
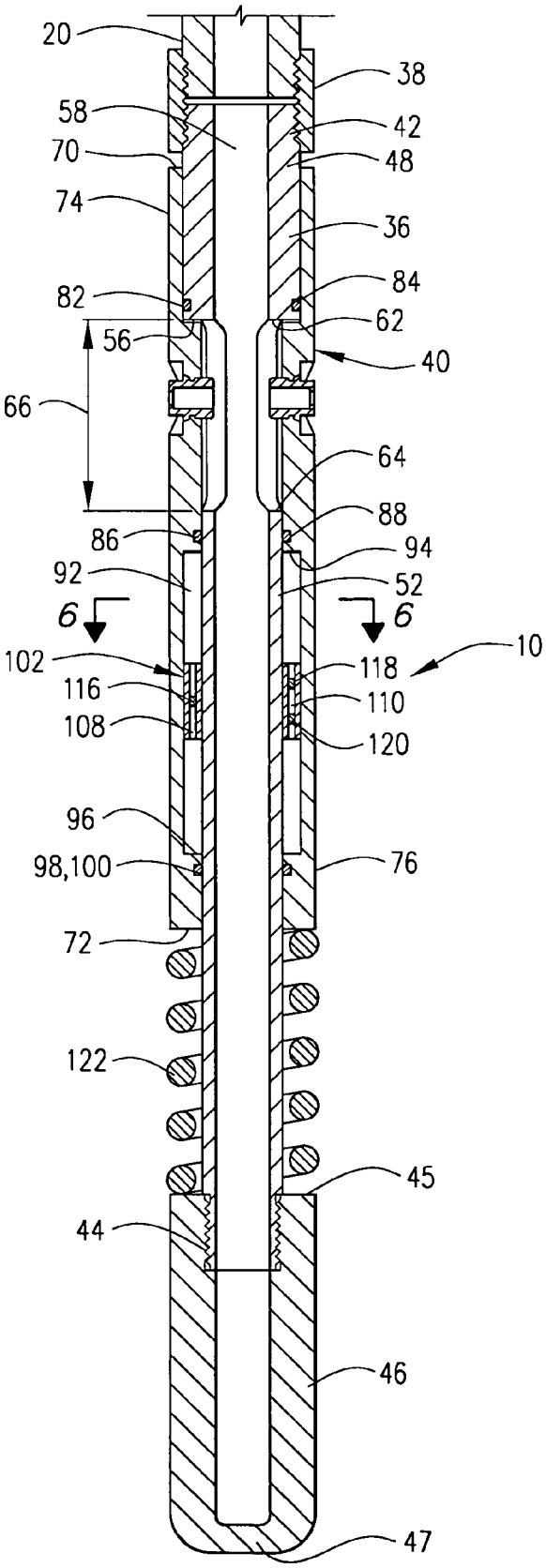
FIG. 2 is a cross-section view of the perforating tool of the present invention in a first or upper position.
Figure 3:
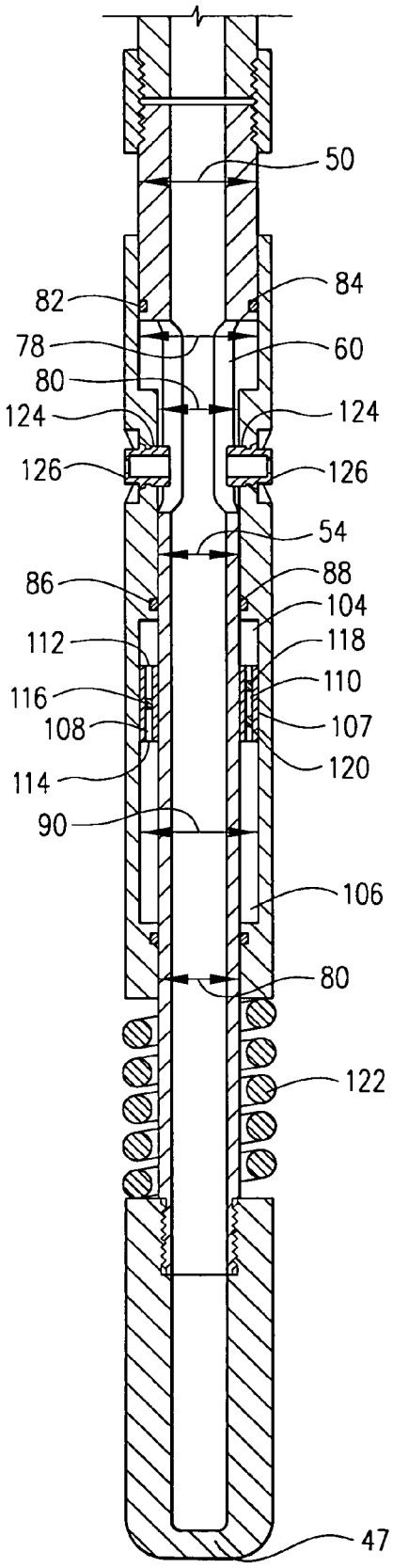
FIG. 3 is a cross-section view of the perforating tool in a second or lower position.

Referring now to FIGS. 2 and 3, jetting tool 10 is shown in a first or upper position. Jetting tool 10 may be utilized to cut perforations or slots in the wall of the well 15, and specifically to cut slots in casing 30 and any cement 31 behind the casing 30. Jetting tool 10 comprises a mandrel 36 which, as set forth hereinabove may be connected to tubing 20 with a tubing connector 38, or collar 38 of a type known in the art. A jetting sleeve 40 is slidably disposed about mandrel 36.

Mandrel 36 has upper end 42 and lower end 44. Mandrel 36 may be threadedly connected at lower end 44 to a bull plug 46 which has a closed end 47 to prevent the flow of fluid therethrough. Any device with a closed end to prevent fluid flow downward therethrough may be connected to mandrel 36.

Mandrel 36 is preferably a stepped mandrel and thus has a first or upper portion 48 having a first outer diameter 50 and a second or lower portion 52 having a second outer diameter 54. Second outer diameter 54 is smaller than first outer diameter 50 and a downward facing shoulder 56 is defined by and extends between first and second outer diameters 50 and 54. Mandrel 36 defines a central passageway 58. Fluid, such as jetting fluid of a type known in the art may be communicated into central passageway 58 from tubing 20.

Mandrel 36 has a plurality of slots 60 therethrough. Slots 60 preferably extend from shoulder 56 toward lower end 44 of mandrel 36. Slots 60 thus have first or upper end 62 and second or lower end 64 defining a length 66 therebetween.

Figure 4:
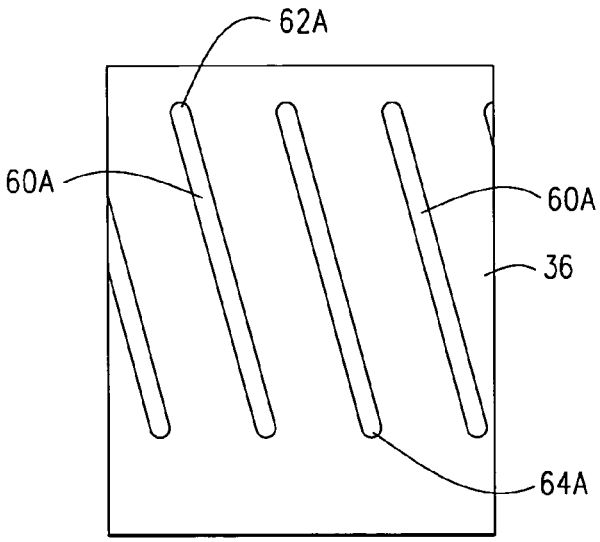
FIG. 4 is an expanded profile view of a portion of an outer surface of a mandrel of the present invention.
Figure 5:
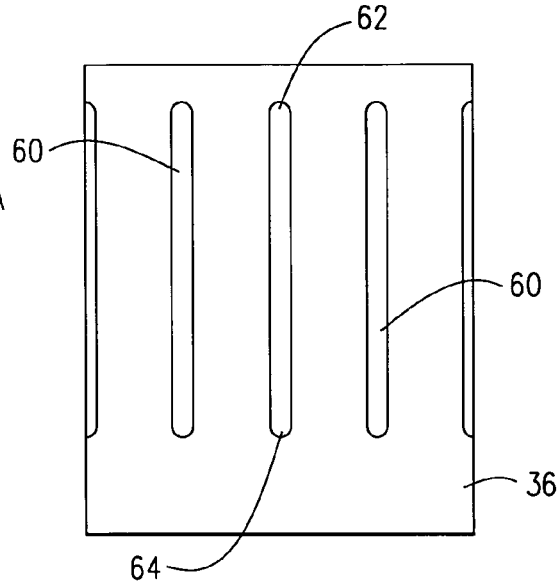
FIG. 5 is an expanded profile view of a portion of an outer surface of an alternative mandrel of the present invention.
Figure 6:
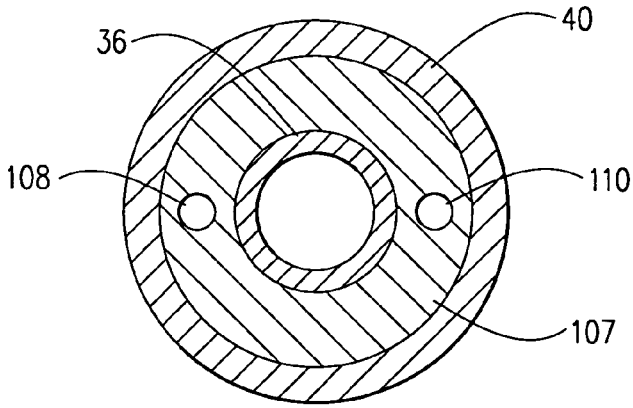
FIG. 6 is a cross-section from line 6—6 of FIG. 2.
Figure 7:
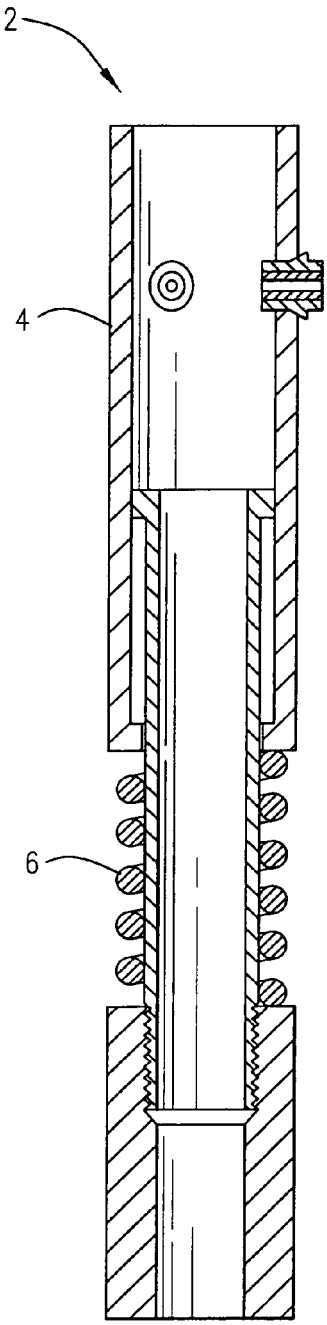
FIG. 7 PRIOR ART
FIGS. 7 and 8 are section views of a prior art tool.
Figure 8:
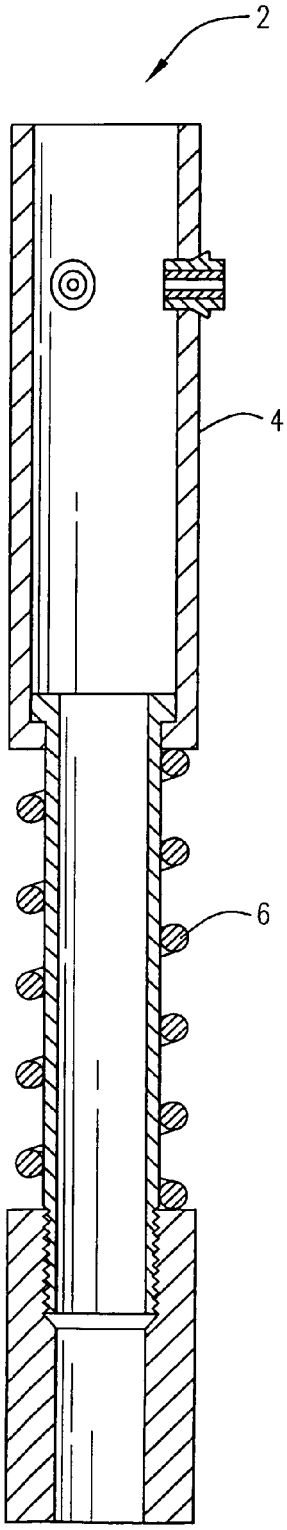
FIG. 8 PRIOR ART

There are preferably four slots 60 equally spaced around the circumference of mandrel 36. As shown in the expanded plan view of the exterior surface of mandrel 36, slots 60 may be vertical slots as shown in FIG. 5, or may have other configurations such as the diagonal configuration shown in FIG. 4. The slots in FIG. 4 are referred to as slots 60A having a first or upper end 62A and second or lower end 64A. As will be explained in more detail hereinbelow, the configuration of the slots 60 in mandrel 36 dictates the configuration of the opening, or slot that will be cut into the casing 30.

Jetting sleeve 40 has first or upper end 70 and second or lower end 72. Jetting sleeve 40 has first and second portions 74 and 76, respectively. First portion 74 defines a first inner diameter 78 and second portion 76 defines a second inner diameter 80. First portion 74 of jetting sleeve 40 is slidably disposed about first portion 48 of mandrel 36. A seal 82 is disposed in a groove 84 in mandrel 36 above slots 60 so that first portion 48 of mandrel 36 is slidably and sealingly engaged by first portion 74 of jetting sleeve 40. A seal 86 is disposed in a groove 88 in jetting sleeve 40. Seal 86 is positioned below lower end 64 of slots 60 so that jetting sleeve 40 slidably and sealingly engages mandrel 36 below slots 60 in the upper and lower positions of jetting sleeve 40. A third inner diameter 90 is defined on second portion 76 of jetting sleeve 40. An annular space 92 having first or upper end 94 and second or lower end 96 is defined by third inner diameter 90 on jetting sleeve 40 and by second outer diameter 54 on mandrel 36. A seal, such as an O-ring seal 98 is disposed in a groove 100 in jetting sleeve 40 below the lower end 96 of annular space 92. A metering device 102 is disposed in annular space 92 and preferably is fixed to mandrel 36.

Metering device 102 divides annular space 92 into an upper chamber 104 and a lower chamber 106 which may be referred to as upper and lower oil chambers 104 and 106, respectively. Metering device 102 may comprise metering cartridge 107 having first and second longitudinal flow paths 108 and 110 extending from the upper end 112 to the lower end 114 thereof.

First longitudinal flow path 108 has a first check valve 116 disposed therein. Second longitudinal flow path 110 has a second check valve 118 disposed therein and has a flow restrictor 120 such as for example a VISCO JET restrictor from Lee Company disposed therein and positioned beneath second check valve 118. A spring 122 is positioned between lower end 72 of jetting sleeve 40 and an upper end 45 of bull plug 46. Upper end 45 may be referred to as a shoulder or platform 45 against which spring 122 rests. Spring 122 urges or biases jetting sleeve 40 towards and into the first position shown in FIG. 2.

Jetting sleeve 40 has a plurality of jetting openings 124 each of which preferably has a jet or jetting nozzle 126 disposed therein. In an exemplary embodiment, jetting sleeve 40 has the same number of jetting openings 124 and jetting nozzles 126 as slots 60 in mandrel 36. Jetting nozzles 126 may extend from jetting openings 124 into slots 60 and thus travel in slots 60 between the first, or upper position shown in FIG. 2 and the second, or lower position shown in FIG. 3. Thus, the jetting sleeve 40 will reciprocate on mandrel 36.

In operation, jetting tool 10 is lowered into well 15 until it is adjacent the location that is to be perforated, which will likely be adjacent an interval or formation such as formation 34 shown in FIG. 1 for the production of hydrocarbons therefrom. Once jetting tool 10 is properly located, jetting fluid can be pumped through tubing 20 into central passageway 58. Fluid flow is blocked by bull plug 46. Pressure can be increased inside the tubing 20 to cause fluid to exit through jetting nozzles 126 at a velocity sufficient to perforate and/or cut the casing 30 so that slots may be cut therein. The fluid flowing through the mandrel 36 acts on the differential area between first and second inner diameters 78 and 80 to urge jetting sleeve 40 axially or longitudinally on mandrel 36.

In an exemplary embodiment, the fluid flowing through mandrel 36 will cause jetting sleeve 40 to move downwardly relative thereto, from its first position shown in FIG. 2 towards and to the second position shown in FIG. 3. Second check valve 118 allows fluid to flow from upper oil chamber 104 to lower oil chamber 106 to allow downward movement of jetting sleeve 40. Second check valve 118 will not allow movement until a predetermined pressure is reached. Once the predetermined pressure is reached, jetting sleeve 40 will move axially from the first to the second position and flow restrictor 120 will control the rate at which jetting sleeve 40 moves downwardly.

Once the second position shown in FIG. 3 is reached, the rate of flow of jetting fluid can be decreased and spring 122 will urge jetting sleeve 40 upwardly toward the first position thereof. First check valve 116 will allow flow from lower oil chamber 106 into upper oil chamber 104. Jetting sleeve 40 thus moves relative to mandrel 36, and to tubing 20, which will be stationary when the jetting sleeve 40 moves to cut openings in casing 30. This operation can be repeated as many times as necessary to cut openings, such as slots in casing 30 and in the cement 31 behind casing 30 and likewise into the formation 34. The shape of the slots will substantially match the shape of the slots 60 in mandrel 36. Because generally vertical slots 60 may be desired, generally vertical slots such as slots 60 will be defined in mandrel 36. Other configurations such as the generally diagonal configuration of slots 60A shown in FIG. 4, which have a longitudinal and a transverse component, may be utilized. By utilizing slots instead of simply holes, a greater area in which to push treating fluids is created and a greater area through which return of production fluids exists. Although in an exemplary embodiment the fluid flow causes jetting sleeve 40 to move downwardly, or in the same direction as the fluid flow, the jetting tool 10 may be configured so that the fluid flow causes jetting sleeve 40 to move upwardly, or in a direction opposite the fluid flow in the mandrel 36, and a spring, or other means utilized to move jetting sleeve 40 in the opposite direction.

Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. A jetting apparatus comprising:

a mandrel defining a flow passage therethrough; and a sleeve slidably disposed about the mandrel;

wherein:

the sleeve defines a plurality of jetting openings; and flow of a jetting fluid through the mandrel moves the sleeve longitudinally in a first direction relative to the mandrel for allowing the jetting fluid to cut slots in a wall of a well through the jetting openings.

2. The apparatus of claim 1 wherein the jetting openings have jetting nozzles disposed therein.

3. The apparatus of claim 1 wherein the sleeve defines a closed annular chamber about the mandrel, and the apparatus further comprises a metering device disposed in the annular chamber for controlling the rate of longitudinal movement of the sleeve.

4. The apparatus of claim 3 wherein the metering device comprises:

an annular ring with first and second longitudinal passageways defined therein;

a fluid restrictor disposed in one of the first or second passageways for controlling the rate of movement of the sleeve; and a check valve disposed in the other of the first or second passageways.

5. The apparatus of claim 4 wherein the check valve allows fluid flow in one direction only, thereby allowing the sleeve to move longitudinally relative to the mandrel in a second direction opposite the first direction.

6. The apparatus of claim 5 further comprising a biasing means for biasing the sleeve in the second direction.

7. The apparatus of claim 6 wherein the biasing means comprises a spring disposed about the mandrel.

8. The apparatus of claim 1 wherein the jetting fluid acts on a differential area on the sleeve, thereby causing the sleeve to move in the same direction as the jetting fluid.

9. The apparatus of claim 8 further comprising means for urging the sleeve in the direction opposite the direction of the jetting fluid flowing in the mandrel.

10. The apparatus of claim 1 wherein:

the jetting openings have jetting nozzles connected therein;

the jetting nozzles extend into slots in the mandrel; and the jetting nozzles travel in the slots when the sleeve moves on the mandrel.

11. The apparatus of claim 10 wherein the slots in the mandrel extend longitudinally from a first to a second end thereof and extend at least partially around the circumference of the mandrel.

12. The apparatus of claim 10 wherein the sleeve rotates relative to the mandrel when the jetting nozzles travel in the slots.

13. The apparatus of claim 1 wherein the wall of the well is defined by a casing therein, and the apparatus cuts openings in the casing.

14. A jetting apparatus comprising:

a mandrel defining a flow passage and having a plurality of slots defined therein; and a sleeve slidably disposed about the mandrel and having a plurality of jetting openings defined therein;

wherein:

the sleeve is movable on the mandrel between first and second positions; and jetting fluid flowing in the mandrel passes through the slots and the jetting openings and causes the sleeve to move in a direction from the first position to the second position.

15. The apparatus of claim 14 further comprising a spring disposed about the mandrel, wherein the spring applies a force to an end of the sleeve to urge the sleeve toward the first position.

16. The apparatus of claim 14 wherein the sleeve may be reciprocated on the mandrel between the first and second positions to cut slots in a wall of a well.

17. The apparatus of claim 14 further comprising jetting nozzles mounted in the jetting openings in the sleeve.

18. The apparatus of claim 17 wherein the jetting nozzles extend into the slots, and the jetting nozzles travel in the slots when the sleeve moves on the mandrel.

19. The apparatus of claim 14 wherein the maximum distance of travel of the sleeve on the mandrel is equal to, or less than, a length of the slots in the mandrel.

20. The apparatus of claim 14 further comprising a means for controlling the rate of travel in the direction from the first to the second position.

21. The apparatus of claim 14 further comprising a metering device for controlling the rate of travel of the sleeve on the mandrel.

22. The apparatus of claim 21 wherein the metering device is disposed in a liquid-filled annular chamber defined by the sleeve and the mandrel.

23. The apparatus of claim 21 wherein:

the metering device comprises an annular ring having first and second passages extending from a first to a second end thereof;

the first passage has a check valve disposed therein; and the second passage has a flow restrictor disposed therein.

24. The apparatus of claim 14 wherein a wall of a well is defined by a casing therein, and the apparatus cuts openings in the casing.

25. A jetting apparatus comprising:

a mandrel defining a flow passage therethrough and having a plurality of slots defined in a wall thereof; and a sleeve slidably disposed about the mandrel and movable between first and second positions;

wherein:

the sleeve defines a plurality of jetting openings therethrough; and jetting fluid is communicated from the flow passage in the mandrel through the slots out the jetting openings to cut a wall of a well.

26. The apparatus of claim 25 wherein the sleeve reciprocates on the mandrel to cut slots in the wall of the well.

27. The apparatus of claim 26 wherein the slots have a first end and a second end defining a slot length extending therebetween, and the distance of travel of the sleeve on the mandrel is equal to, or less than, the length of the slots in the mandrel.

28. The apparatus of claim 25 further comprising a spring disposed about the mandrel, wherein the spring biases the sleeve toward the first position.

29. The apparatus of claim 25 further comprising jetting nozzles mounted in the jetting openings.

30. The apparatus of claim 29 wherein the jetting nozzles travel in the slots.

31. The apparatus of claim 30 wherein the sleeve rotates relative to the mandrel as it slides longitudinally on the mandrel.

32. The apparatus of claim 25 wherein the wall of the well is defined by a casing therein, and the apparatus cuts openings in the casing.

33. A method of cutting an opening in a wall of a well, comprising the steps of:

placing a tool in the well, wherein the tool comprises a mandrel with a sleeve slidably disposed thereabout;

reciprocating the sleeve on the mandrel; and jetting fluid through slots in the mandrel and openings in the sleeve to cut openings in the wall.

34. The method of claim 33 wherein the step of jetting fluid moves the sleeve in a first direction on the mandrel.

35. The method of claim 34 wherein the step of reciprocating further comprises the step of applying a force to the sleeve in a direction opposite the first direction.

36. The method of claim 33 wherein the step of reciprocating further comprises the steps of:

applying a hydraulic force to the sleeve to move the sleeve in a first direction; and applying a mechanical force to move the sleeve in a second direction opposite the first direction.

* * * * *